United States Patent [19]

Saito et al.

[11] 4,359,963

[45] Nov. 23, 1982

[54] FIXING DEVICE

[75] Inventors: Takashi Saito, Ichikawa; Michio Shigenobu; Tsukasa Kuge, both of Tokyo; Masaaki Sakurai, Hanno; Hiroyuki Adachi, Tokyo, all of Japan

[73] Assignee: Canon Kabushiki Kaisha, Tokyo, Japan

[21] Appl. No.: 141,917

[22] Filed: Apr. 21, 1980

[30] Foreign Application Priority Data

Apr. 28, 1979 [JP] Japan ..... 54-52637
Apr. 28, 1979 [JP] Japan ..... 54-52638
Apr. 28, 1979 [JP] Japan ..... 54-52639

[51] Int. Cl.[3] ..... G03G 15/10

[52] U.S. Cl. ..... 118/60; 118/101; 118/260; 432/60

[58] Field of Search ..... 118/60, 70, 260, 101, 118/104; 432/60; 219/216; 355/3 FU

[56] References Cited

U.S. PATENT DOCUMENTS 3,964,431 6/1976 Namiki ..... 118/60
4,182,263 1/1980 Naeser et al. ..... 118/260

FOREIGN PATENT DOCUMENTS 52-110049 9/1977 Japan ..... 118/60
54-37752 3/1979 Japan ..... 118/60

*Primary Examiner*—John P. McIntosh
*Attorney, Agent, or Firm*—Fitzpatrick, Cella, Harper & Scinto

[57] ABSTRACT

A device for fixing a toner image on an image supporting member includes a first and a second roller for conveying the image supporting member while holding it therebetween and fixing the toner image on the image supporting member, and an applicator being in contact with the first roller and applying offset preventing liquid to the first roller. The portion of contact of the applicator with the first roller is provided with a first portion contacting the fixing action area of the first roller and a second portion including the end areas of the portion of contact with respect to the lengthwise direction of the first roller. The applicator has, in at least the portion of contact, a liquid amount control member formed of synthetic resin having fine continuous pores. The offset preventing liquid oozes out to the surface of the synthetic resin through the fine continuous pores and is applied to the first roller. The applicator further has an obstructing member for obstructing the ooozing of the offset preventing liquid from the second portion of portion of contact.

65 Claims, 22 Drawing Figures

FIXING DEVICE

BACKGROUND OF THE INVENTION

1. Field of the Invention

This invention relates to a toner image fixing device.

2. Description of the Prior Art

In a field so as electrophotography which deals with toner images, a device designed such that a toner image supporting member is conveyed while being held between a pair of rollers at least one of which is heated from the inside or the outside thereof whereby toner is heated and melted and fixed on the supporting member has often been used as the device for fixing a toner image on the supporting member and in that case, in order to prevent offset of the toner and twisting of the supporting member about the roller, it is well-known to apply offset preventing liquid (usually, silicone oil) to the fixing roller against which the toner image bearing surface of the supporting member is urged.

The device heretofore practically used to apply the offset preventing liquid to the fixing roller is a device in which felt having absorbed and retained the silicone oil by capillary phenomenon is brought into direct contact with the fixing roller or brought into contact with an applicator roller rotating while being in contact with the fixing roller or one roller of an applicator roller train comprising a plurality of rollers rotating while being in contact with each other, whereby the silicone oil is supplied and applied to the fixing roller. In such device, however, too much oil tends to be applied and therefore, the toner image supporting member is stained with the oil and later, when ink is applied to the supporting member, the ink does not spread well and in addition, slippage occurs between the fixing roller and the pressing roller to disturb the toner image. Also, a greater amount of oil than necessary is uneconomically consumed and this has led to a high frequency with which the oil is supplied or the oil supply cartridge is replaced by a new one, which in turn has meant cumbersomeness of maintenance. U.S. Pat. No. 3,718,116, U.S. Pat. No. 3,745,972 and Japanese Utility Model Publication No. 51168/1978 disclose devices which use two-layer felt comprising felt of thin fiber density and felt of thick fiber density and in which the felt of thick fiber density is brought into contact with the roller to reduce the amount of oil applied. In these devices, however, the amount of oil applied is still great and a greater amount of oil than necessary is applied to the roller to prevent the offset and the twisting of the supporting member about the roller. Moreover, in the above-described devices, streak-like application irregularities tend to occur and it is very difficult to uniformly apply a small amount of oil.

Another serious disadvantage of the above-described devices in which felt is brought into contact with the roller to apply the offset preventing liquid to the roller is that toner or paper powder or carrier particles contained in the latent image developer forming the toner image clog the felt, whereby application irregularities are often caused. If such application irregularities occur, the offset of the toner partly occurs and the image supporting member twists about the roller and in addition, where the fixing roller and the pressing roller are covered with a parting material such as silicone rubber having an offset preventing liquid absorbing characteristic, there is an inconvenience that said application irregularities result from a difference in the amount of swell between the rollers and wrinkles tend to occur to the toner supporting member. Further, when a great amount of toner adheres to said felt, this will damage the roller and further expedite the aforementioned application irregularities, thus causing various unsatisfactory fixation effects.

On the other hand, a method is conceivable in which a silicone rubber roller having its rubber structure impregnated with silicone oil or a roller comprising an apertured pipe containing therein silicone oil and covered with silicone rubber is brought into contact with the fixing roller to apply offset preventing liquid to the fixing roller through the rubber structure. According to such a method, uniform application of a slight amount of oil would be possible, but the amount of oil applied would be too slight and this would be entirely unsuitable for a device in which seven or eight or more sheets of A4 size paper must be processed for fixation per minute, such as the fixing devices used in the present-day copying apparatus. Further, in this method, as the viscosity of the liquid is higher, the amount of liquid applied would be further reduced.

As a device which provides a means to overcome the above-noted various inconveniences, there are the fixing devices disclosed in Japanese Laid-open Patent Application Nos. 110049/1977 and 37752/1979. The fixing devices described in these two laid-open patent applications are designed such that the amount of silicone oil applied to the fixing roller is controlled by non-fibrous high-molecular synthetic resin having fine continuous pores, namely, not a material such as felt comprising entangled fibers or a sponge having a great quantity of air bubbles dispersed in synthetic resin material, but a high-molecular synthetic resin material having a great number of fine pores extending from the front surface of the synthetic resin material to the back surface thereof. For such material, tetrafluoroethylene having continuous pores such as GORE-TEX (produced by W. L. GORE & ASSOCIATES, INC., tradename) or FLUOROPORE (produced by Sumitomo Denki-Kogyo K. K., tradename) is preferable. In the devices of the aforementioned two laid-open patent applications using such synthetic resin material, the fine continuous pores are not clogged with toner or paper powder and accordingly, there occurs no inconvenience that the amount of oil applied is decreased with time and application irregularities begin to occur. It has been confirmed by the inventor that, in the case of the devices described in said two laid-open patent applications, both high-viscosity liquid and low-viscosity liquid are controlled to an appropriate amount and uniformly applied in the central area of said synthetic resin material with respect to the lengthwise direction of the roller while, in the opposite end portions thereof, the amount of liquid applied tends to be great. This is considered to be attributable to the fact that when the applicator is urged against the roller, the offset preventing liquid contained in the applicator tends to move outwardly in the lengthwise direction of the roller at the end portions of the synthetic resin material with respect to the lengthwise direction of the roller. In any case, if the amount of liquid applied to the roller is great at the end portions of the synthetic resin material with respect to the lengthwise direction of the roller, this may result in slippage between the fixing roller and the pressing roller, swell irregularity of the roller covered with silicone rubber, liquid-contamination of the toner image supporting member, etc. and in addition, a greater amount of liquid than necessary may be uneconomically consumed.

SUMMARY OF THE INVENTION

It is an object of the present invention to provide a fixing device which can overcome the above-noted various inconveniences.

It is another object of the present invention to provide a fixing device which can economically consume offset preventing liquid.

It is still another object of the present invention to provide a fixing device which can prevent toner image supporting members from being contaminated by the offset preventing liquid.

It is yet still another object of the present invention to provide a fixing device which can prevent a liquid amount control member from being clogged with toner, paper powder or the like.

It is a further object of the present invention to provide a fixing device which enables an appropriate amount of offset preventing liquid to be applied also at the end portions of the roller.

It is a further object of the present invention to provide a fixing device which enables an appropriate amount of offset preventing liquid to be applied to any portion of the roller.

Other objects and features of the present invention will become apparent from the following detailed description taken in conjunction with the accompanying drawings.

DESCRIPTION OF THE PREFERRED EMBODIMENTS

Figure 1:
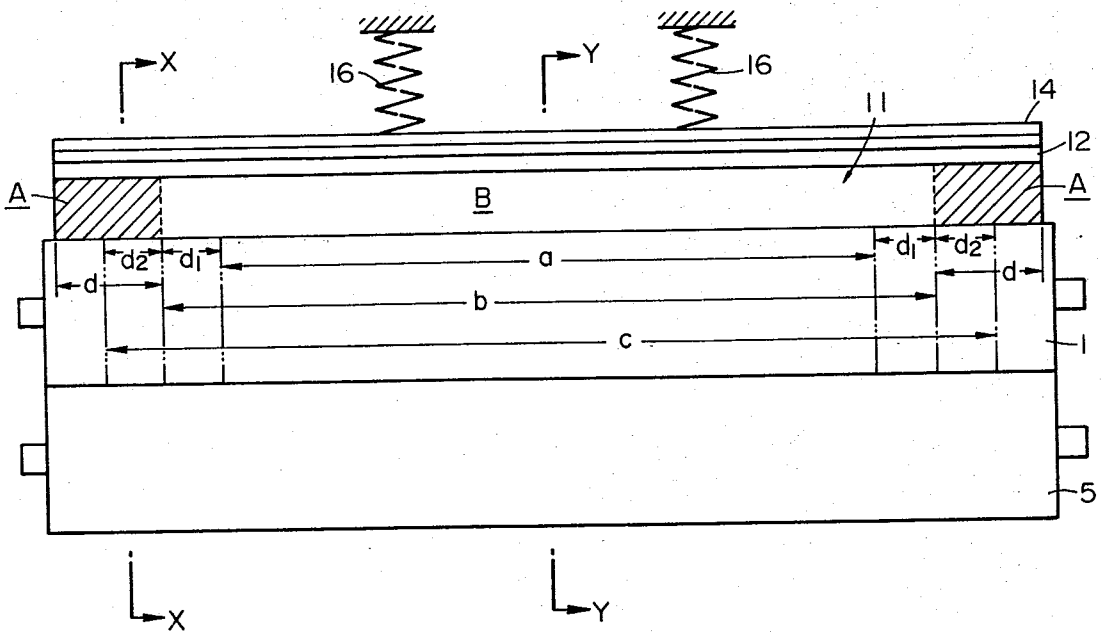
FIG. 1 is a view for illustrating an embodiment of the present invention.
Figure 2:
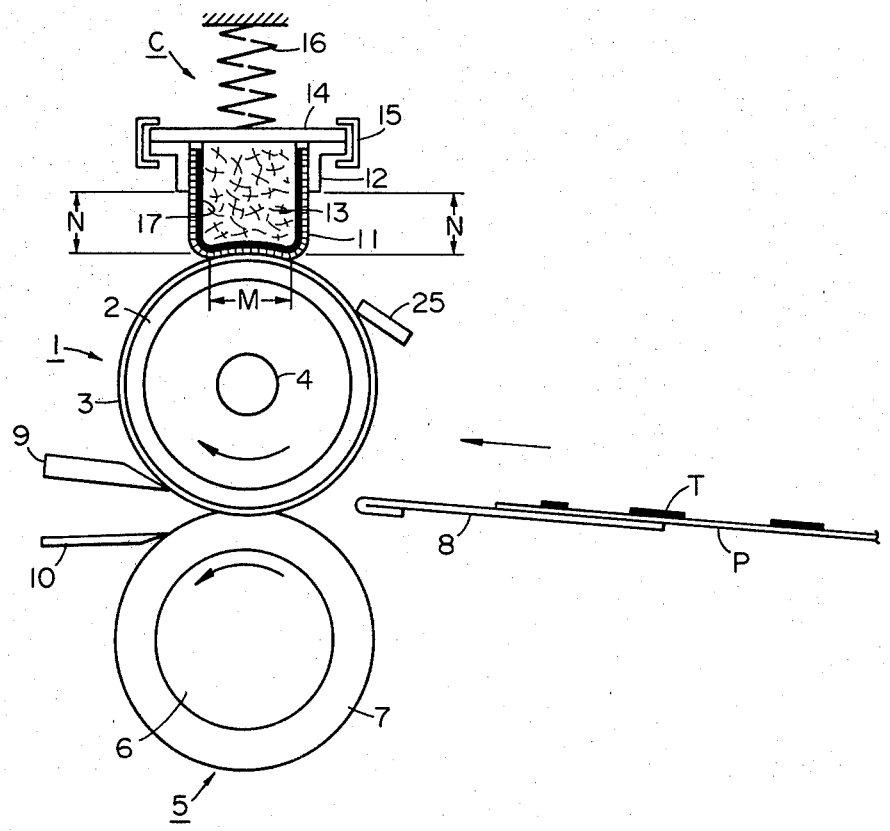
FIG. 2 is a cross-sectional view taken along line X—X of FIG. 1.
Figure 3:
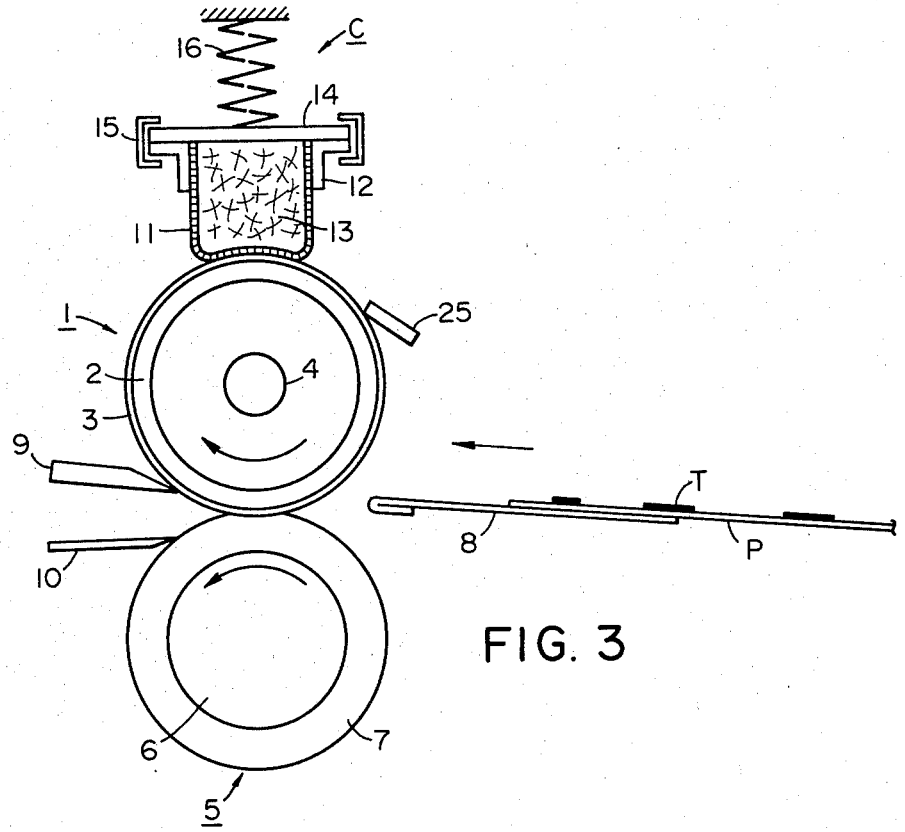
FIG. 3 is a cross-sectional view taken along line Y—Y of FIG. 1.

Referring to FIGS. 1, 2 and 3, reference numeral 1 designates a fixing roller comprising a metal hollow pipe 2 covered with a thin coating 3 of offset preventing material such as silicone rubber, tetrafluoroethylene resin or the like. A heater 4 is disposed in the hollow of the roller 1 and the peripheral surface of the roller 1 is heated by this heater to a temperature capable of melting and fixing toner (usually 150°-200° C.). Designated by 5 is a pressing roller having therewithin a mandrel roll 6 covered with a thick coating 7 of offset preventing soft elastic material, for example, silicone rubber. The pressing roller 5 is urged against the fixing roller 1 and is elastically deformed at the urged portion thereof as shown to form a nip portion which nips a toner image supporting member between it and the fixing roller. One of the rollers 1 and 5 is rotatively driven by a motor, not shown, and the other is rotated by the friction force with the rotatively driven roller. That is, the rollers 1 and 5 are rotated in the directions of arrows, respectively, and nip and convey the toner image supporting paper P at said nip portion. At that time, toner image T is heat-melted and adheres to the paper P and is fixed. The toner image supporting surface of the paper P is urged against the fixing roller 1. The paper P is guided by a guide plate 8 and conveyed into said nip portion and, after having passed through the nip, the paper is separated from the rollers by pawl-like members 9 and 10 lightly bearing against the rollers 1 and 5, respectively.

Now, reference numeral 11 designates a non-fibrous high-molecular synthetic resin film not having air bubbles like those of a sponge but having fine continuous pores regularly distributed on the outside diameter, as already described. As the material for such film, fluorine resin is usually suited since it has is excellent heat resisting properties, wear resisting properties and oil resisting properties, as well as being smooth-surfaced, slippery, soft and rich in flexibility and excellent in the so-called offset preventing property which means the difficulty with which melted toner adheres, is usually suitable, but tetrafluoroethylene resin, which is superior in the above-mentioned characteristics, is presently best suited. Tetrafluoroethylene resin having fine continuous pores, includes the materials sold under the tradenames of FLUOROPORE, GORE-TEX, etc. The manufacturing method and characteristics of such tetrafluoroethylene resin are disclosed in Japanese Patent Publication No. 13560/1967, Japanese Patent Publication No. 3068/1973, Japanese Laid-open Patent Application No. 7284/1971 and Japanese Laid-open Patent Application No. 22881/1975. Of course, the resin materials applicable to the present invention are not restricted to the above-described ones, and other fluorine resins or vinyl chloride resins having fine continuous pores are also usable.

In any case, the diameters of the fine continuous pores formed in the above-mentioned synthetic resin material are very regular throughout the resin material, and the diameter distribution concentrates to about 100% in very narrow pores of about the average diameter and presents a delta function form.

Turning back to the drawings, the high-molecular synthetic resin film 11 having fine continuous pores is formed into an elongated, relatively shallow bag which is long in the lengthwise direction of the roller 1 and narrow in the rotational direction of the roller, and the opening portion of the bag is fixed to a support frame 12. The bag of the film 11 is filled with heat-resistant felt 13 having silicone oil absorbed and retained thereby, so that at the surface of contact of the felt 13 with the film 11, oil is supplied from the felt 13 to the film 11. A lid 14 is attached to the frame 12 by means of screws. An applicator C thus constructed may be removed from the fixing device by pulling it out along guide rails 15 toward this side as viewed in FIGS. 2 and 3. After the applicator C has been removed from the fixing device in this manner, the lid 14 may be opened to permit silicone oil to be supplied to the felt 13, whereafter the applicator C may again be inserted along the guide rails 15, whereby it may be set on the fixing device. Alternatively, the applicator C may be formed as a cassette type and when the oil in the felt 13 is exhausted, the applicator may be pulled out of the fixing device in the above-described manner, whereafter another applicator with felt 13 impregnated with oil may be inserted and set. In any case, when the applicator C is being set on the fixing device, the bottom surface of the bag of the high-molecular synthetic resin film 11 having fine continuous pores is pressed against the fixing roller 1 by the gravity of the applicator C or by the spring force of a spring 16 provided so as to force down the lid 14. The high-molecular synthetic resin film 11 such as FLUOROPORE or GORE-TEX has good flexibility and the felt 13 is also elastically deformable, so that by said pressing, the bottom surface of the film 11 is deformed along the peripheral surface of the roller 1 and thus, the film 11 uniformly makes surface-contact with the roller 1, as shown. Thus, the silicone oil in the felt 13 oozes out to the film surface through the fine continuous pores of the film 11 and is applied to the roller 1 in the area of contact between the film 11 and the roller 1.

As already described, the fine continuous pores of the film 11 such as FLUOROPORE or GORE-TEX are never clogged with toner or paper powder and there is no such inconvenience that the amount of oil applied is reduced with time, as experienced when felt is used, or that streak-like application irregularities are created. However, when the applicator C is urged against the roller 1 as described above, the oil in the felt 13 contained in the bag of the film 11 tends to ooze out to the film surface more heavily at the end portions of the film 11 than at the central portion thereof with respect to the direction of the bus bar of the roller. Accordingly, if no remedial action is exerted, the amount of oil applied would differ from the central portion of the roller 1 to the opposite end portions thereof with respect to the lengthwise direction of the roller and more oil would be applied to the latter to cause the aforementioned inconvenience.

Therefore, in the embodiment of FIGS. 1, 2 and 3, at the areas A indicated by broken lines in FIG. 1, namely, at the opposite end portions of the film 11 (with respect to the lengthwise direction of the roller 1 and accordingly, the lengthwise direction of the bag of the film 11), a thin film 17 of silicone sealant or like material having good flexibility is applied to the inner surface of the film 11 (that surface which is opposite to the surface contacting the roller 1) to close the continuous pores at the opposite end portions of the film 11. Accordingly, at the areas A to which the sealant 17 has been applied, the silicone oil in the felt 13 does not ooze out to the surface of the film 11. On the other hand, in the area B in FIG. 1, namely, the film area to which no sealant is applied, the silicone oil oozes out to the surface of the film 11 through the fine continuous pores and is applied to the roller 1, and in this area B, the amount of oil oozing out from the felt 13 to the film surface through the fine continuous pores is uniform with respect to the lengthwise direction of the roller.

Of course, the area B of the film 11 is brought into contact with the fixing action area of the roller 1. Most preferably, the length of the area B in the lengthwise direction of the roller is set so that the opposite ends of the area B (with respect to the lengthwise direction of the roller) are located slightly outward of the opposite ends of said fixing action area (with respect to the lengthwise direction of the roller), but the opposite ends of the area B may also be coincident with or located slightly inward of the opposite ends of said fixing action area. If the fixing action area in the first case is a and the fixing action area in the second and the third case is b and c, respectively, the distance $d_1$ in FIG. 1, namely, the distance $d_1$ between the end of the area a and the end of the area B in the lengthwise direction of the roller, may suitably be about 1 to about 10 mm, and the distance $d_2$, namely, the distance $d_2$ between the end of the area c and the end of the area B, may suitably be 1 to about 15 mm. The length d of the area A in the lengthwise direction of the roller, namely, the distance d between said end of the area B and said end of the film 11, may suitably be 2 to about 25 mm. Of course, the optimal values of the distances d, $d_1$ and $d_2$ are variable by such factors as the volume of the bag of the film 11, the length of the bag in the direction of the bus bar of the roller, the area of contact between the bag and the roller 1, the pressure of contact therebetween, the average diameter of the continuous pores, the rate of the pores, etc., but in the ordinary fixing device used with an electrophotographic apparatus or the like, said distances are generally determined within the aforementioned value ranges. As regards the distances d, $d_1$ and $d_2$, what has been described above also applies to the following embodiments.

The term "fixing action area" of the roller used hereinabove refers to that area of the peripheral surface of the roller against which the toner image supporting member is urged. The roller is usually constructed so as to be longer than the width of the fixing action area with respect to the lengthwise direction thereof.

Figure 4:
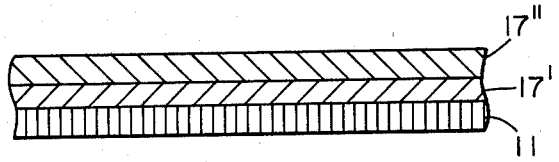
FIG. 4 illustrates an example of the obstructing member.

In the above-described embodiment, silicone sealant or like material has been applied to the area A to close the continuous pores therin, but in the area A, a high-molecular synthetic resin film which is non-porous and accordingly is not permeable to silicone oil and which has good flexibility may also be joined to the film 11 having continuous pores to thereby close the pores. For example, as shown in FIG. 4, a film 17′ of tetrafluoroethylenepropylene hexafluoride copolymer resin (melting point about 260° C.) may be disposed on the Fluoropore film (melting point about 320° C.) 11, and a film 17″ of tetrafluoroethylene resin (melting point about 320°) may further be disposed thereon, and these may be heated and pressed so as to be joined to each other. The heating temperature in that case may suitably be 250° to 300° C., and should preferably be lower than the melting points of the films 11 and 17″ and higher than the melting point of the film 17′. The films 17′ and 17″ are non-porous and entirely impermeable to silicone oil. In any case, if a film ready to melt is used as the intermediate layer, a good joining condition may be obtained, but only the layer 17′ or only the layer 17″ may be heated at a temperature lower than the melting point of the film 11 and joined to the film 11. Alternatively, in the areas A, a high-molecular synthetic resin film 17″ also having fine continuous pores may be joined to the film 11 having continuous pores. In this case, the film 17''' may be laminated with the intermediate layer 17' of FIG. 4 interposed between the film 11 and the film 17''', but the film 17''' may be joined directly to the film 11 by heating and pressing the film 17''' at a temperature lower than the melting point of the film 11. In this latter case, part of the continuous pores of the film 11 communicates with part of the continuous pores of the film 17''' so that a very slight amount of oil oozes out from the felt 13 to the surface of the film 11. However, it is only part of the pores that communicates and the other continuous pores of the film 11 are closed by the non-porous surface of the film 17''' and therefore, the amount of oil oozing in the areas A is much smaller than that in the area B. Consequently, even by such pore closing method, a sufficient effect can be achieved as compared with a case where no remedial action is exerted. The material of the film 17''' may be identical to or different from the material of the film 11.

Figure 5:
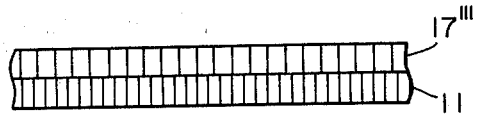
FIG. 5 illustrates another example of the obstructing member.

Besides the aforementioned method of applying the sealant 17 or the closing films 17', 17'', 17''' to the areas A, it is also possible to heat and press the area A of the film 11 and thereby crush part or whole of the continuous pores in those areas. In this case, if only part of the pores is crushed, a very slight amount of oil would ooze out to the surface of the film 11 as in the case of FIG. 5, but that amount is slight as compared with the amount of ooze in the area B, and a much greater effect would be obtained than in a case where no treatment is exerted. Accordingly, both the member which is entirely impermeable to silicone oil such as the sealant 17, the non-porous closing films 17', 17'' or the film 11 in the area A, wherein all of the continuous pores have been heated and destroyed and the member which is partly impermeable to silicone oil such as the closing film 17''' having fine continuous pores or the film 11 in the area A wherein part of the continuous pores has been heated and destroyed are herein referred to as the obstructing member.

Now, in the embodiment of FIGS. 1, 2 and 3, at the end portions of the film 11 with respect to the lengthwise direction of the roller 1, not only the portion M of the film which contacts the roller 1 but also the side portion N of the film which contacts the atmosphere has been subjected to the oil impermeation or oil permeation reducing treatment, whereas such treatment may be applied only to the area M of the end portion of the film 11 which contacts the roller 1. However, it is perferable that the said oil impermeation or oil permeation reducing treatment be applied to the area N as well as to the area M, because it is not only in the area M but also in the area N that the oil strongly tends to ooze out at the end portions of the bag-like member of the film 11 with respect to the lengthwise direction of the roller. Accordingly, where the said oil impermeation or oil permeation reducing treatment is not applied to the area N, the oil oozing out from the area N would flow down to wet the end portions of the roller 1. To prevent this, the aforementioned obstructing member should preferably be applied to both areas N and M.

Further, to prevent the oil oozing out from the side of the film 11 and flowing down to wet the roller, said obstructing member may be provided on the side of the bag member of the film 11 not only at the end portions thereof with respect to the lengthwise direction of the roller, but also at the central portion thereof, thereby applying the oil impermeation or oil permeation reducing treatment thereto. An embodiment of such construction will now be described.

Figure 6:
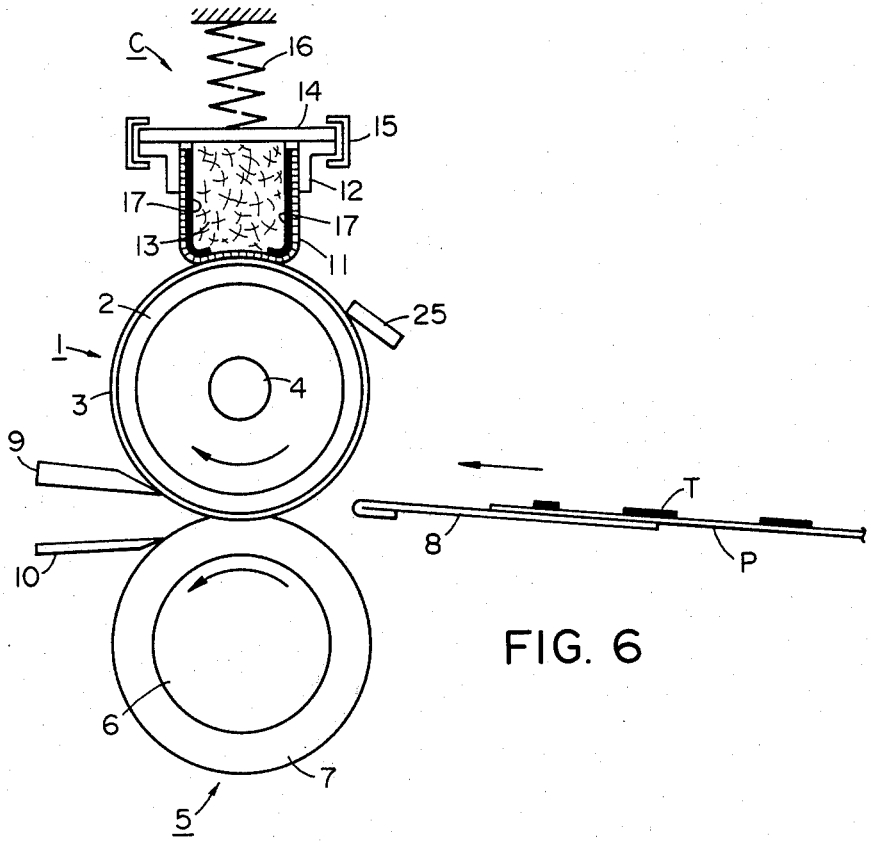
FIG. 6 illustrates another embodiment of the present invention.

FIG. 6 is a cross-sectional view of the portion corresponding to the cross-section Y—Y of FIG. 1, and the cross-sectional view of the portion of the FIG. 6 embodiment corresponding to the cross-section X—X of FIG. 1 is the same as FIG. 2. In the embodiment of FIG. 6, sealant 17 is applied to the back side of not only the end portions of the film 11 (with respect to the lengthwise direction of the roller) but also the central portion of the film which does not contact the roller 1 but contacts the atmosphere, in the manner already described. In FIG. 6, instead of the sealant 17, both or at least one of the non-porous high-molecular synthetic resin films 17' and 17'' may be joined to the side of the film 11. Alternatively, in FIG. 6, instead of applying the sealant 17, part or whole of the fine continuous pores in the side of the film 11 may be crushed by heating and pressing. In any case, in the embodiment of FIG. 6, as shown in FIGS. 7, 8, 9 and 10, the area B of the film 11 is entirely surrounded by the area A in which the silicone oil does not ooze out to the film surface or the amount of ooze is greatly reduced. Of course, the area B is brought into contact with the fixing action area of the roller 1.

Figure 7:
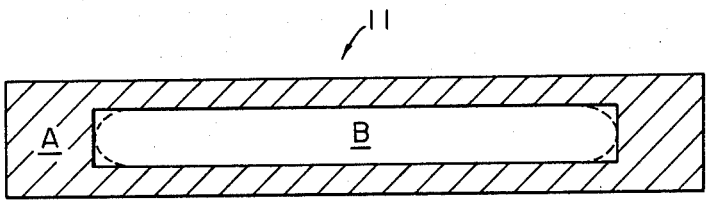
FIGS. 7 to 10 are developed views of control members.

FIGS. 7, 8, 9 and 10 are developed views of the bag of the film 11. In FIG. 7, the area B is a long rectangular form. (The lengthwise direction of the area B is in accord with the lengthwise direction of the roller 1). In FIG. 7, the ends of the area B may be formed in an arcuate shape as indicated by the broken line.

Figure 8:
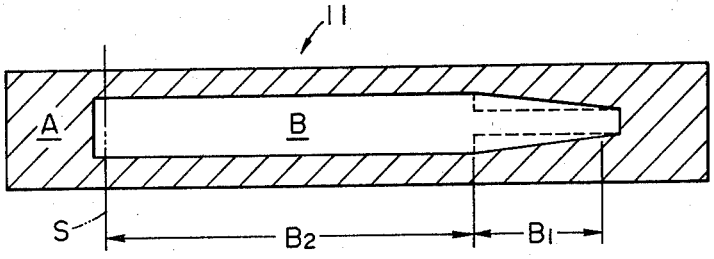

Now, in a device wherein sheets of paper P having different width dimensions with respect to the lengthwise direction of the roller are selectively subjected to the fixation treatment, the amount of oil consumed by the roller surface contacted by the central portion of the area B differs from the amount of oil consumed by the roller surface contacted by at least one end portion of the area B, because paper P of any width size contacts the former roller surface while only paper P having a large width size contacts the latter roller surface. Accordingly, in the example shown in FIG. 8, the width of the area B (with respect to the rotational direction of the roller) in the portion $B_1$ which is brought into contact with the peripheral area of the roller 1 contacted only by paper having a maximum width size is smaller than the width of the area B (with respect to the rotational direction of the roller) in the portion $B_2$ which is brought into contact with the peripheral area of the roller contacted both by paper of a minimum width size and paper of a maximum width size and thus, the amount of oil applied in the portion $B_1$ is smaller than that in the portion $B_2$. The film 11 of the FIG. 8 example is used in a fixing device constructed such that paper of any width size is conveyed with one end thereof in the width direction being coincident with a common standard line S set at one end of the fixing roller 1. The left end portion of the area B as viewed in FIG. 8 is brought into contact with the fixing roller 1 at the standard line S. In FIG. 8, the width of the area B in the portion $B_1$ is gradually decreased with respect to the lengthwise direction of the roller, whereas this portion may be formed into a rectangular shape similarly to the portion $B_2$, as indicted by the broken line. This holds true with the ensuing examples. What is important is that the width of the area B of the film 11 be made smaller in at least one end portion thereof with respect to the lengthwise direction of the roller. That is, in that portion which is brought into contact with the fixing action area of the roller directed only to paper of a maximum width size, than in the central portion thereof with respect to in the lengthwise direction of the roller, or, for example, that portion which is brought into contact with the fixing action area of the roller commonly directed to paper of any width size.

Figure 9:
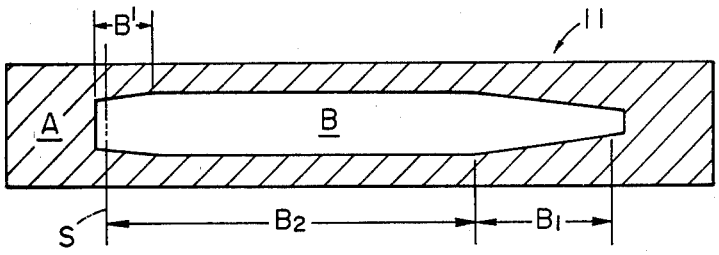

FIG. 9 shows an improved example over the FIG. 8 example. In FIG. 8, the width of the area B at the standard line S side is equal to the width of the central portion. In this case, if the roller is made sufficiently longer than the width of the paper having a maximum width size and accordingly, the length of the film 11 in the lengthwise direction of the roller is also made sufficiently longer and the length of the area A in the lengthwise direction of the roller is made sufficiently longer, the amount of oil oozing from the area B can be rendered very uniform from one end to the other end of the portion $B_2$ with respect to the lengthwise direction of the roller, whereas the aforementioned lengths are usually limited. Therefore, usually, even in the area B, the amount of oil ooze is somewhat greater at the standard line S side end portion than at the central portion. Thus, in the embodiment of FIG. 9, the width of the end portion B' of the area B which is brought into contact with the standard line S portion is made somewhat smaller than that of the central portion to thereby prevent the above-described inconvenience. The width of the left end of the portion B' is greater than the width of the right end of the portion $B_1$. Such portion B' may be provided at each end portion of the area B in FIG. 7.

Figure 10:
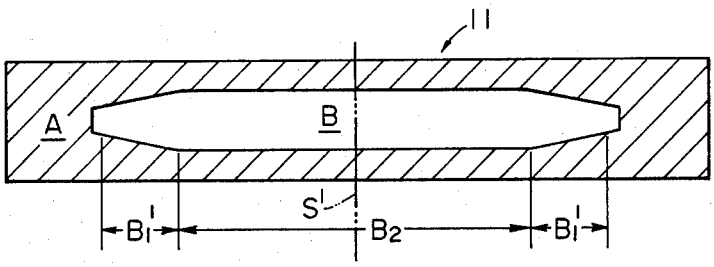

FIG. 10 shows a film for use in a fixing device constructed such that the widthwise centers of paper sheets having different width sizes pass the lengthwise center S' of the roller. In this example, the opposite end portions $B_1'$ of the area B which are brought into contact with the fixing action area of the roller directed only to the end portions of large-size paper are smaller in width than the central portion $B_2$. The area B is symmetrical with respect to the lengthwise center line. The example shown in FIG. 10 is also endowed with the effect described in connection with the embodiment of FIG. 9, of course.

If sealant is applied or other film is joined to the area A in FIGS. 7–10, as described previously, these will act as a liner which will reinforce the film.

Here, for reference, the data of an experiment using the film of FIG. 7 will be shown. Fluoropore film having a thickness of 0.2 mm was used as the film 11. The average diameter of the continuous pores was 1μ (the pore diameter distribution concentrates substantially 100% in the range of ±0.4μ about this 1μ), and the pore rate was 80%. The length and width of the rectangular area B were 300 mm and 7 mm, respectively, and the whole surface of the area B was brought into contact with the roller. The contact pressure was about 1 g/mm$^2$. The length of the area A at the end portion of the bag of the film 11 in the lengthwise direction of the roller (d in FIG. 1) was 5 mm. The viscosity of the silicone oil used was 10000 CS (room temperature). The temperature of the roller 1 was 190° to 200° C., and the peripheral velocity thereof was 120 mm/sec. The area A was formed by applying silicone sealant and closing the continuous pores, and the pore rate of this area A was apparently 0.

In the above-described device, the amount of oil consumed was about of 0.00005–0.0001 cc per sheet of JIS Standard B4 size paper. Oil was uniformly applied to the roller 1, and the inconvenience of the amount of oil applied being increased at the end portion and the rubber layer of the roller 5 where it swells more than in the central portion, the inconvenience that paper is stained by the oil, and the inconvenience that slippage occurs between the rollers 1 and 5 to disturb the toner image never occurred throughout the fixing process of 100,000 sheets of B4 paper. Of course, neither toner offset nor twisting of paper about the roller neither occurred. Even after 100,000 sheets of B4 paper were processed for fixation, the continuous pores of the film 11 were not clogged with toner or paper powder and were available for continued use.

For reference, the amount of oil consumed when the oil was applied without providing the area A was 0.0001–0.0003 cc per sheet of B4 paper, which and this is about three times the amount of oil consumed in the aformentioned experiment.

Figure 11:
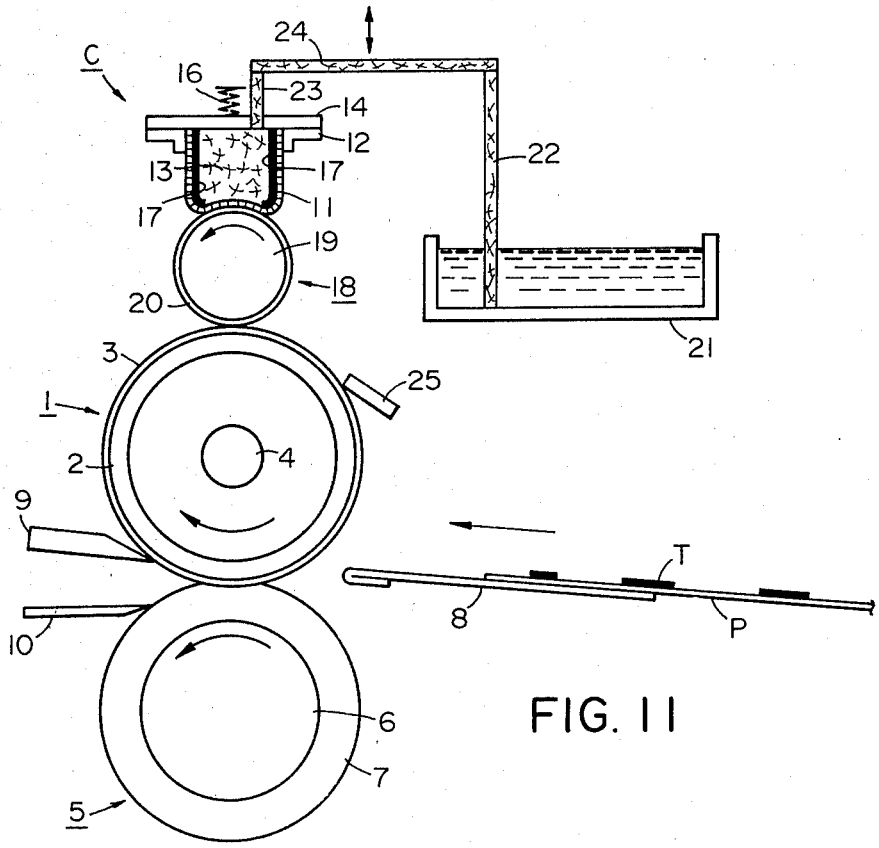
FIG. 11 illustrates a further embodiment of the present invention.

FIG. 11 illustrates another embodiment of the present invention. In FIG. 11, reference numeral 18 designates an applicator roller which comprises a metal core roll 19 covered with a thin layer 20 of tetrafluoroethylene resin. The applicator roller 18 is in contact with a fixing roller 1 having a thin coating 3 of silicone rubber and is rotated in the direction of the arrow. A film 11 of Fluoropore formed into a bag-like shape is fixed to a frame 12, and the film 11 is formed with the area A as aforementioned by any one of the previously described methods, and the fixing action corresponding area of the roller 18 is brought into contact with the area B of the film 11. The fixing action corresponding area of the roller 18 refers to the peripheral area of the roller 18 which contacts the peripheral area of the roller 1 which contacts the toner image supporting member. What has been described in connection with FIGS. 1 and 7 to 10 regarding the contact positional relation of the area B of the film 11 with the roller 1 equally applies to the contact positional relation of the area B with the roller 18 in the embodiment of FIG. 11.

Now, the silicone oil in the felt 13 oozing out through the fine continuous pores of the open area of the film 11 is first applied to the roller 18, and then applied to the fixing roller 1 with the rotation of the roller 18. The roller 18 may be one which is rotated by the friction force between it and the roller 1, but alternatively it may be rotatively driven by a motor, not shown. In this case, the roller 18 may be rotated also in the direction opposite to the direction of the arrow and in any case, if the roller 18 is rotatively driven so that the peripheral velocity thereof is lower than the peripheral velocity of the roller 1, the amount of oil applied to the roller 1 can be reduced. (In this case, the layer 3 also may preferably be formed of wear-resistant tetrafluoroethylene resin).

A rotatable multi-stage applicator roller train may also be provided between the roller 1 and the film 11, or an endless belt which is movable round may be used instead of the applicator roller. In the embodiment of FIG. 11, the member 13 is not pre-impregnated with silicone oil, but silicone oil is supplied from an oil pan 21 to the member 13. Designated by 22 is felt having its lower end immersed in the oil within the pan 21, and designated by 23 is felt having its lower end bearing against the felt 13 through a hole provided in the lid 14. Felt 24 interconnects the felt 22 and the felt 24. The felt 24 is brought to bear against the felt 22 and 23 during the rotation of the rollers 1, 2 and 18, as shown, so that the oil in the pan 21 is transmitted and supplied to the felt 13 by capillary phenomenon through the felt 22, 24 and 23 and, during the non-rotation of the rollers 1, 2 and 18, namely, during the down-time of the fixing device, the felt 24 is spaced apart from the felt 22 and 23 to stop the supply of the oil. Such method of supplying oil from the oil pan is also applicable to the previous embodiment.

Figure 12:
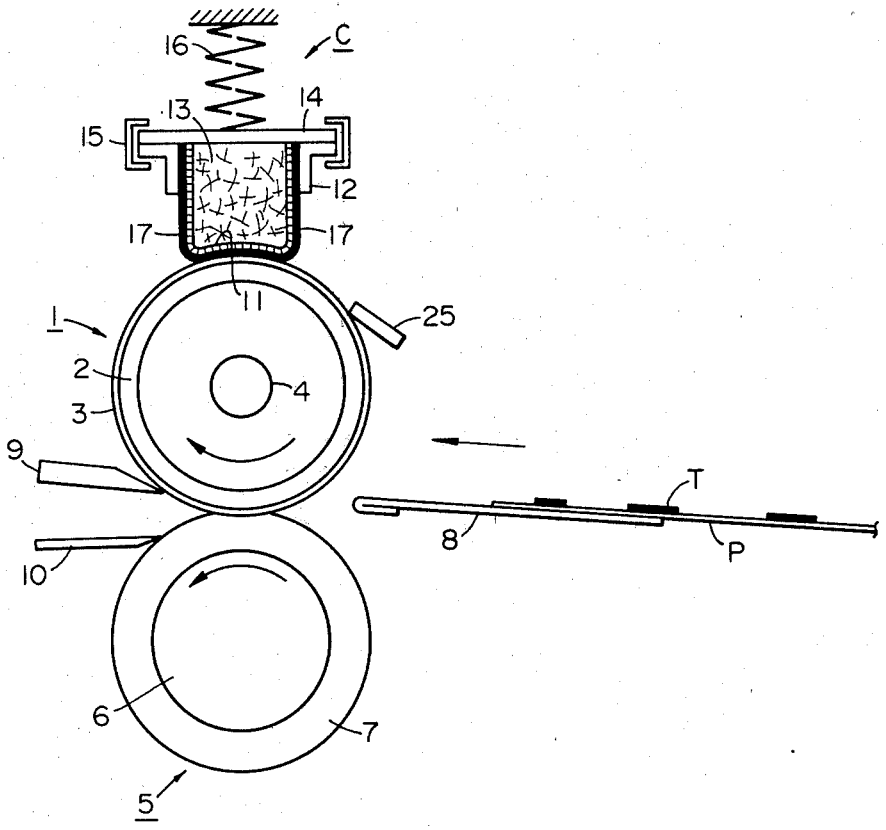
FIGS. 12 and 13 illustrate a further embodiment of the present invention.
Figure 13:
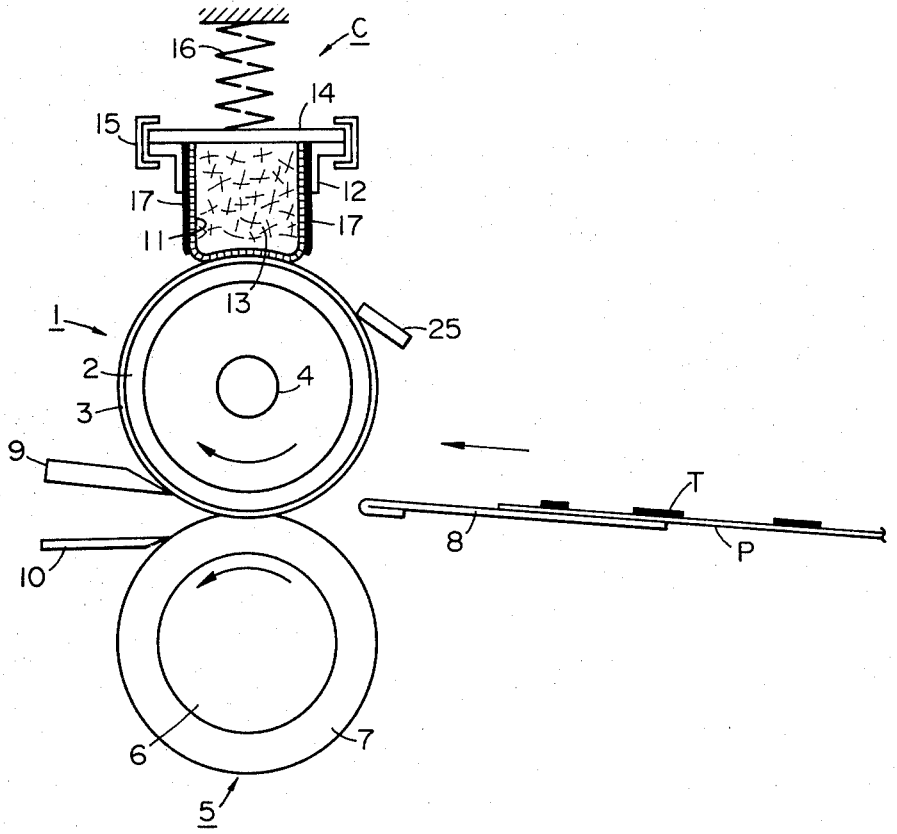

In the above-described embodiments, the blockading members 17, 17′, 17″ and 17‴ are provided on the back side of the film 17. However, as shown in FIGS. 12 and 13, the blockading member 17 (or at least one of the blockading members 17′, 17″ and 17‴) may be provided on the front surface (that surface which contacts the roller) of the film 11 by said method. Alternatively, the blockading member 17 (or at least one of the blockading members 17′, 17″ and 17‴) may be provided on both surfaces of the film 11 by said method. FIG. 12 is a view corresponding to the X—X cross-section of FIG. 1, and FIG. 13 is a view corresponding to the Y—Y cross-section of FIG. 1.

Figure 14:
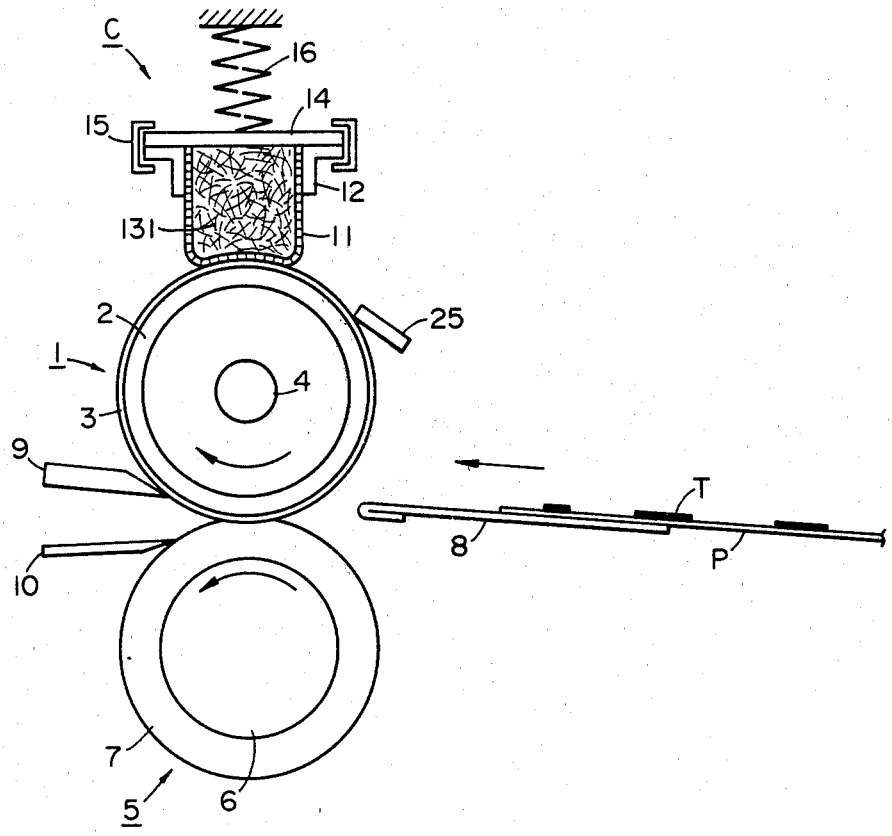
FIGS. 14 and 15 illustrate a further embodiment of the present invention.
Figure 15:
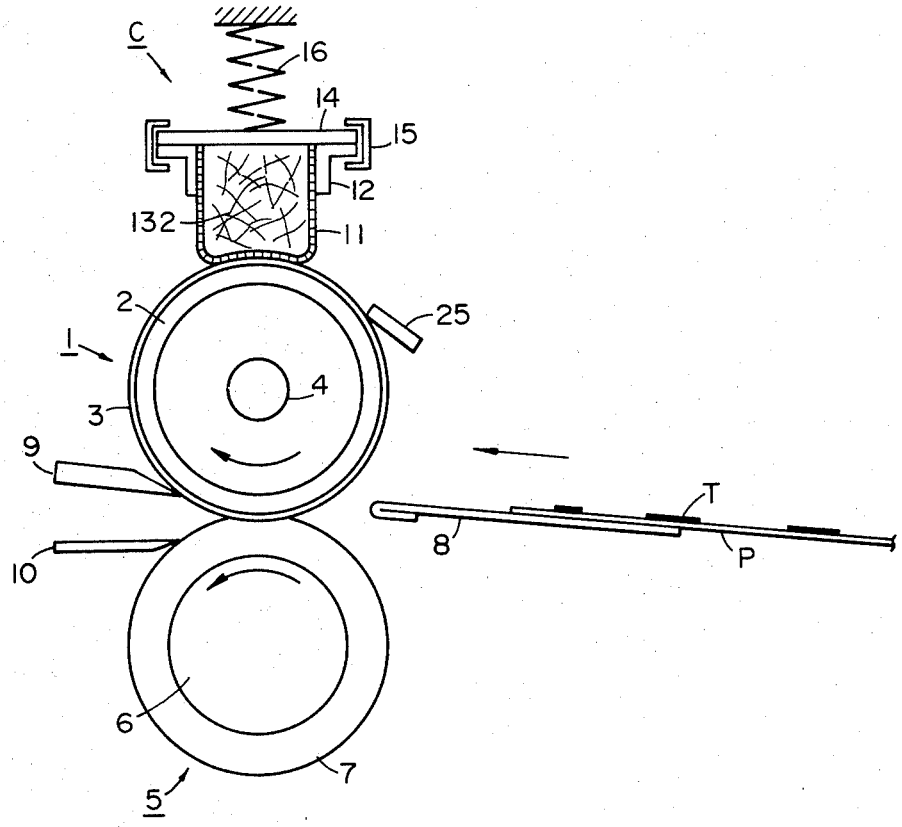

In the embodiments of FIGS. 14 and 15, felt 131 bearing against the back surface of the film 11 in the areas A indicated by broken lines in FIG. 1 is higher in fiber density than felt 132 bearing against the back surface of the film 11 in the area B. That is, the felt 131 is inferior to its felt 132 in the capability of absorbing oil per unit volume and accordingly, in its capability of retaining the oil and its capability of supplying the oil to the film 11. If the felt 131 is felt of fiber meltable by heat, such as felt of nylon fiber, and the surface thereof, at least the surface thereof which bears against the film 11, is preheated to melt the surface fiber, and as many inter-fiber clearances as possible are immersed, then the amount of oil oozing from the felt 131 will be further effectively reduced. In any case, by using the high-density felt 131, the amount of silicone oil oozing out to the surface of the film 11 in the areas A can be remarkably reduced as compared with that in the area B. Also, if an elastic material like fluorine rubber not impregnated with silicone oil is used in lieu of the felt 131, the amount of oil oozing out to the surface of the film 11 in the areas A may be made zero or approximate to zero, more effectively. On the other hand, in the surface of the film in the area B which contacts the roller 1, the amount of oil oozing out from the felt 132 to the surface of the film through the fine continuous pores of the film 11 is neither too much nor too little but is adequate to prevent offset or twisting of paper P about the roller and moreover, is substantially uniform with respect to the direction of the bus bar of the roller. FIG. 14 is a view corresponding to the X—X cross-section of FIG. 1, and FIG. 15 is a view corresponding to the Y—Y cross-section of FIG. 1. What has been described with respect to d, $d_1$ and $d_2$ in FIG. 1 also applies to this embodiment and ensuing embodiments.

Figure 16:
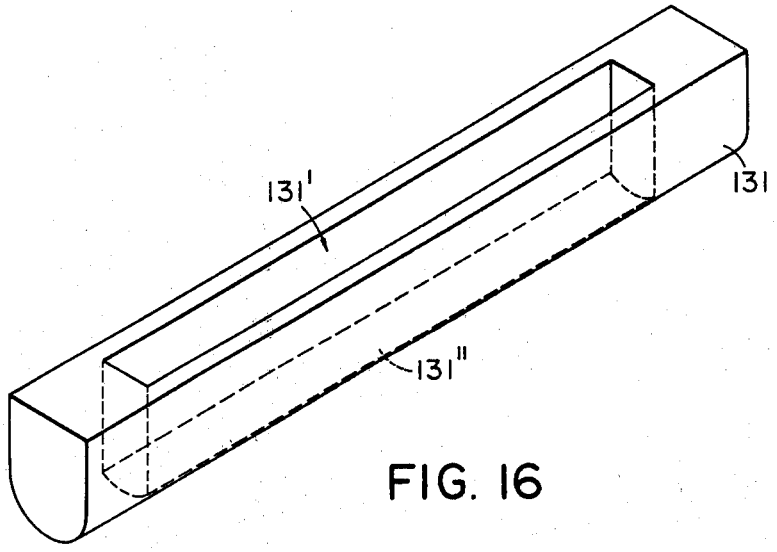
FIG. 16 illustrates another example of the obstructing member.

In the area B, in order to prevent the oil from oozing and flowing down from the side of the bag of the film 11, namely, the surface thereof which is exposed to the atmosphere, there is a method of heating the surface portion of the felt 132 bearing against the back surface of the film 11 in that portion corresponding to the side of said bag to melt the fiber in that surface portion, and reducing the inter-fiber clearances to thereby reduce the oozing force of the oil from the same portion, but it is technically difficult to heat and melt only the surface of part of the felt. Therefore, it is better to construct high fiber density felt 131 so as to have an elongated opening 131′ in the lengthwise direction of the roller, as shown in FIG. 16, and to fill this opening 131′ with low fiber density felt 132. The felt 131 bears against the area A of the film 11 of FIG. 7, and the bottom surface of the felt 132 bears against the area B of FIG. 7. The surface of the felt 131 which bears against the film 11 may preferably be heated to melt the fiber thereof and reduce the inter-fiber clearances. If the obstructing member 131 as shown in FIG. 16 is used, it will act as a kind of shell to maintain the shape of the bag containing the roller against the rotation of the roller and maintain constant the area and position of contact of the film 11 with the roller.

Figure 17:
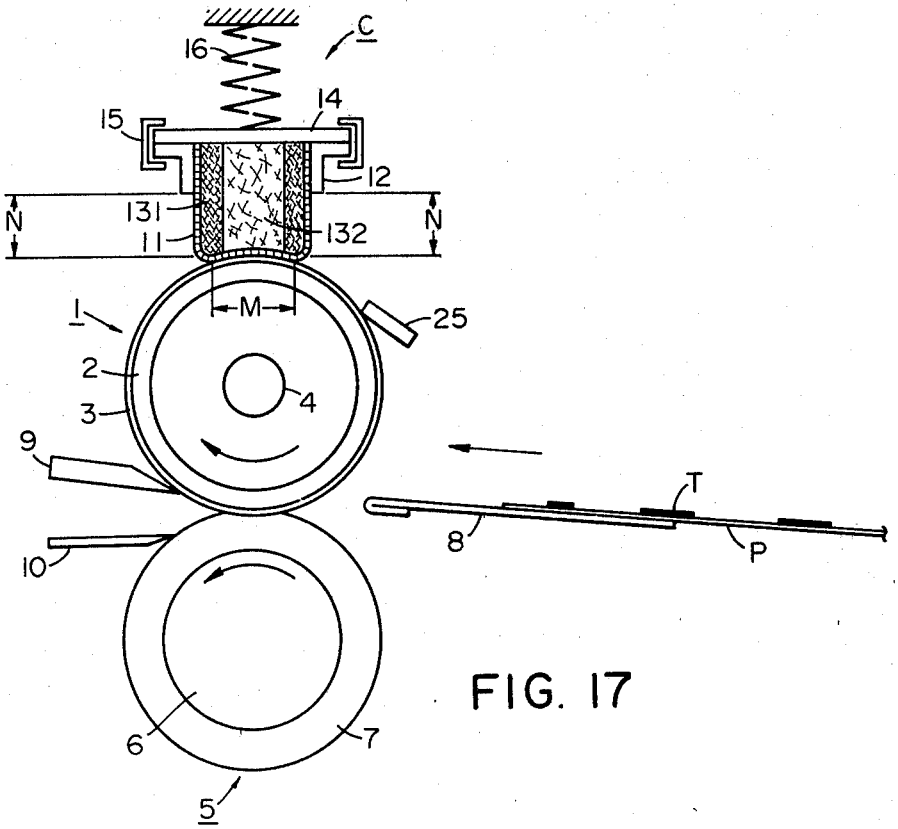
FIG. 17 illustrates a further embodiment of the present invention.

FIG. 17 is a cross-sectional view of the portion of a device using the felt 131 of FIG. 16 which corresponds to the Y—Y cross-section of FIG. 1, and the cross-sectional view of the portion of this embodiment which corresponds to the X—X cross-section of FIG. 1 which is the same as FIG. 14. If, in FIG. 16, the obstructing member 131 is formed of fluorine rubber or like material not having the capability of absorbing and retaining oil, there will be obtained a higher effect.

Also, the shape of the bottom opening 131″ of the member 131 of FIG. 16 may of course be formed like the area B of FIGS. 8, 9 or 10. In any case, the obstructing member 131 bears against the area A of the film 11 which is shown by hatching, and the oil supplying member 132 bears against the area B.

Here, the data of an experiment using the device of FIG. 14 or 15 will be shown for reference. Fluoropore film having a thickness of 0.2 mm was used as the film 11. The average diameter of the continuous pores was 1μ (the pore diameter distribution concentrates substantially 100% in the range of ±0.4μ about this 1μ), and the pore rate was 80%. The pressure of contact was about 1 g/mm$^2$. The length of the area A at the end portion of the bag of the film 11 in the lengthwise direction of the roller (d in FIG. 1) was 5 mm. The viscosity of the silicone oil used was 10000 cs (room temperature). The temperature of the roller 1 was 190° to 200° C. and the peripheral velocity thereof was 120 mm/sec. The felt 132 was nylon fiber felt having a thickness of 5 mm and a fiber density of about 300 g per m$^2$, and the felt 131 was nylon fiber felt having a thickness of 5 mm and a fiber density of about 530 g per m$^2$ and having the surface layer thereof subjected to the heating and melting treatment. In the above-described device, the amount of oil consumed was about $5\times10^{-5}$–$2\times10^{-4}$ cc per sheet of JIS Standard B4 size paper. Oil was uniformly applied to the roller 1, causing the inconvenience of the amount of oil applied being abnormally increased at the end portions to cause the rubber layer of the roller 5 to swell from the central portion thereof, the inconvenience of the paper being stained by oil and the inconvenience that slippage occurs between the rollers 1 and 5 to disturb the toner image hardly occurred throughout the fixation process of 100,000 sheets of B4 size paper. Of course, neither toner offset nor twisting of paper about the roller occurred. Even after 100,000 sheets of B4 size paper were processed for fixation, the continuous pores of the film 11 were not clogged with toner or paper powder and were available for continued use.

Figure 18:
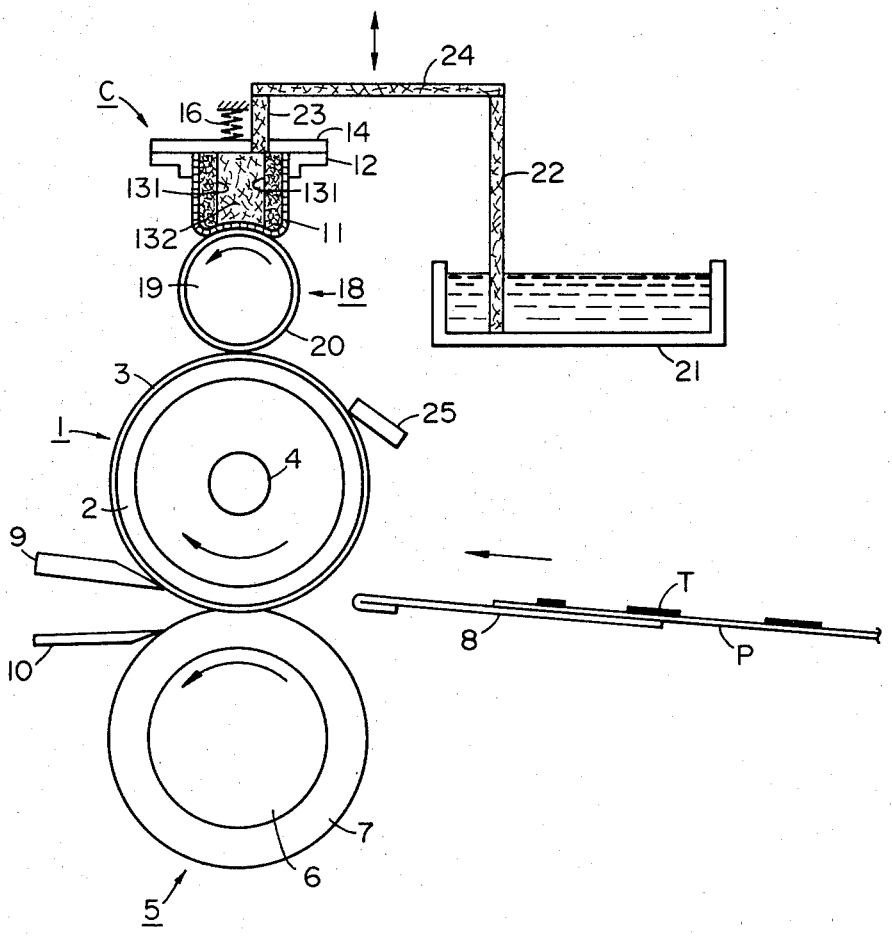
FIG. 18 illustrates a further embodiment of the present invention.

The applicator C described in connection with FIGS. 14, 15, 16 and 17 may be used instead of the applicator C of FIG. 11. This is shown in FIG. 18. What has been described in connection with FIG. 11 also applies to the embodiment of FIG. 18.

The film-like member formed of synthetic resin having fine continuous pores, such as the film-like member of Fluoropore or GORE-TEX, can be produced by elongating lump-like synthetic resin having fine continuous pores by means of a roller or the like. Comparing the percentages of elongation of the film when a force is imparted in the direction of the surface of the film, the percentage of elongation with respect to the direction in which the film was elongated during said machining is smaller than the percentage of elongation with respect to the direction orthogonal thereto. Accordingly, it is preferable that the direction in which the film 11 was elongated and the rotational direction of the roller 1 or 18 be coincident or intersect each other in the portion whereat the two contact each other. This is because the film has a strong resistance against the elongating deformation due to the friction force of the roller rotation, in the direction in which it was elongated. However, in a case where the friction coefficient between the film and the roller is small, the film may be caused to bear against the roller while being oriented in any direction.

In the foregoing embodiments, only a single liquid amount control film 11 has been used in the area of contact with the roller. However, for example, in order to further reduce the amount of offset preventing liquid applied to the roller, the control layer may be formed by a plurality of layered synthetic resin films having fine continuous pores.

Figure 19:
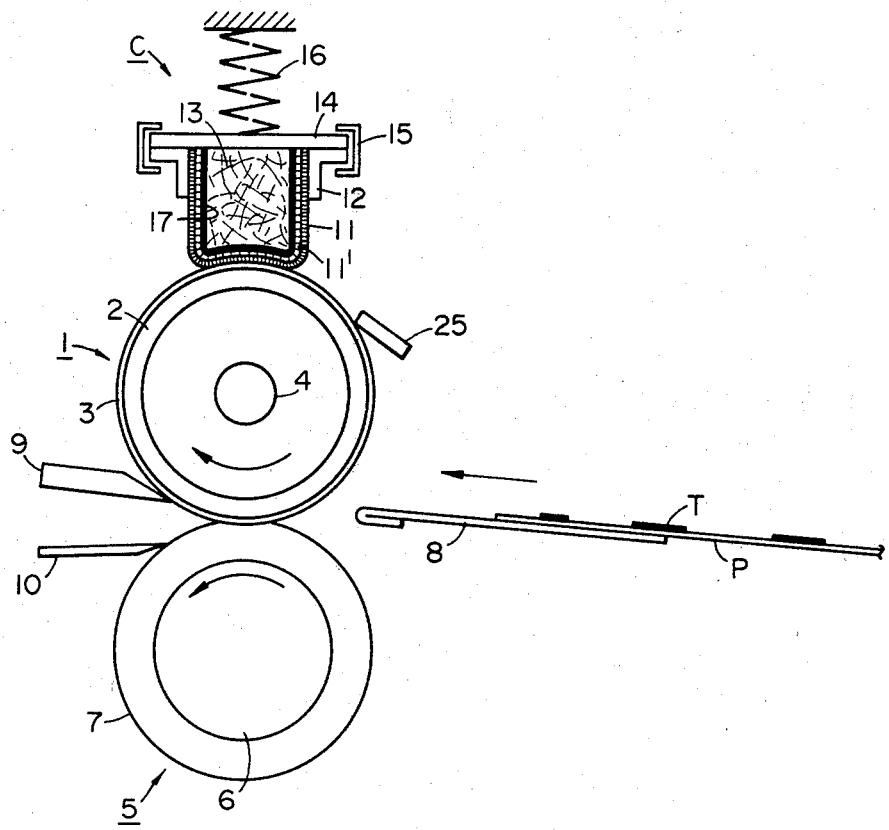
FIGS. 19 and 20 illustrate a further embodiment of the present invention.
Figure 20:
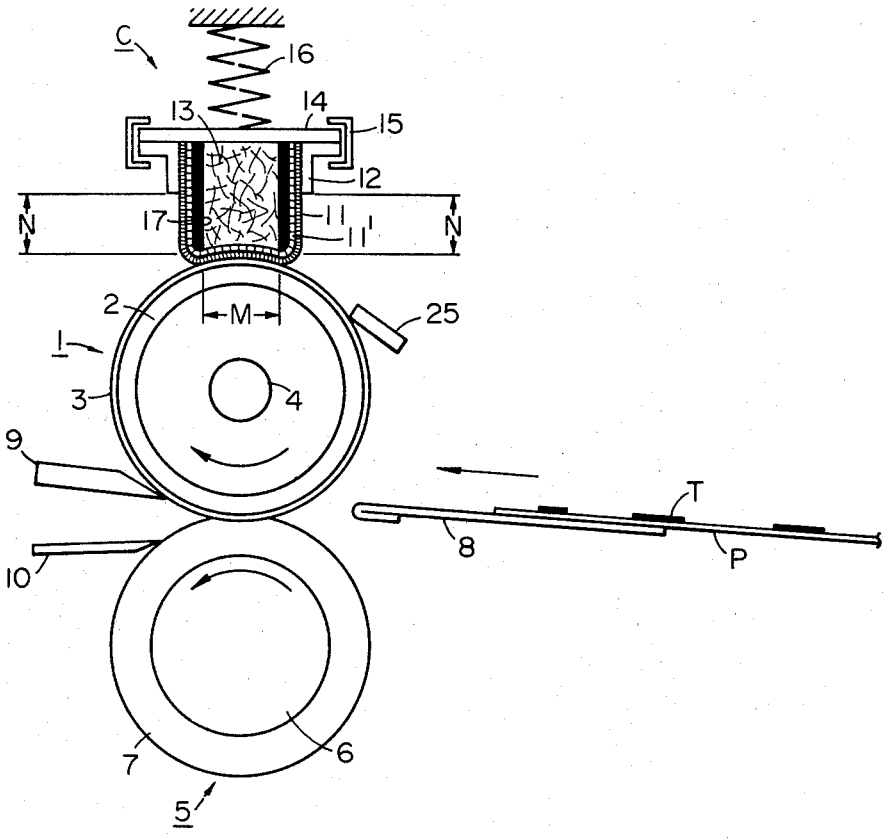

In FIGS. 19 and 20, a synthetic resin film 11' having fine continuous pores is joined to the back side of the film 11 by heating and pressing. Further, silicone sealant 17 is applied to the back side of the film 11'. The area A to which the sealant is applied is similar to what has been described in connection with FIGS. 1, 2, 3, 7, 8, 9 and 10. Instead of applying the sealant 17, the aforementioned nonporous synthetic resin film 17', 17'' or the film 17'' having fine pores may be joined to the back side of the film 11' in the area A. Or alternatively, the obstructing members 17, 17', 17'', 17''' may be sandwiched between the films 11 and 11' in the area A, or may be provided on the surface of the film 11. FIG. 19 is a view corresponding to the X—X cross-section of FIG. 1, and FIG. 20 is a view corresponding to the Y—Y cross-section of FIG. 1.

In the embodiments of FIGS. 19 and 20, the material of the film 11' may be identical to or different from the material of the film 11. Also, the film 11' may be identical to or different from the film 11 in terms of film thickness, average pore diameter of the fine continuous pores and pore rate. In any case, due to the lamination of the films 11 and 11', part of the continuous pores of the film 11 is closed by the non-open surface portion of the pores of the film 11' but the other part communicates with the continuous pores of the film 11'. Thus, the apparent pore rate of the layer comprising the films 11 and 11' is smaller than the pore rates of the films 11 and 11', respectively. Also, it is preferable in improving the anti-elongation characteristic of the layer that the films 11 and 11' be joined together so that the directions in which they were elongated are orthogonal or intersect each other. By doing so, even if the layer is brought into contact with the roller while being oriented in any direction, the direction of elongation of at least one of the films 11 and 11' intersects the rotational direction of the roller. It is most preferable that the layer be brought into contact with the roller while being oriented so that the direction of elongation of one of the films 11 and 11' is coincident with the rotational direction of the roller 1. However, the films 11 and 11' may safely be joined together so that their directions of elongation are coincident with each other. Further, a layer provided by heating, pressing and joining together three or more synthetic resin films having fine continuous pores is also usable in the present invention and in this case, what has been described above applies. Also, the applicator C described in connection with FIGS. 19 and 20 can be used as the applicator C of FIG. 11.

In the above-described embodiments, oil absorbed and retained by the felt 13 or 132 is supplied to the bottom surface of the bag formed by the film 11, namely, the portion of the bag which contacts the roller, whereas such oil retaining member may be removed and the interior of the bag may be filled with oil. The oil retaining member 13 or 132 is not restricted to felt, but may be any member capable of absorbing and retaining oil, such as a fibrous member like woven cloth, unwoven cloth or similar material or a member, such as sponge or the like. Also, the member 131 may be a fibrous member such as woven cloth or unwoven cloth, or sponge or silicone rubber, provided that it is inferior to the member 132 in the capability of absorbing oil per unit volume, i.e., the capability of retaining oil per unit volume. The member 131, as mentioned previously, may also be a material which is entirely incapable of absorbing silicone oil. In short, the member 131 may be a material which is inferior to the member 132 in the capability of retaining liquid per unit volume.

In the foregoing embodiments, use is made of a film-like member of synthetic resin having fine continuous pores, but it is also possible to control the amount of liquid by using a bar-like or plate-like member of such synthetic resin.

Figure 21:
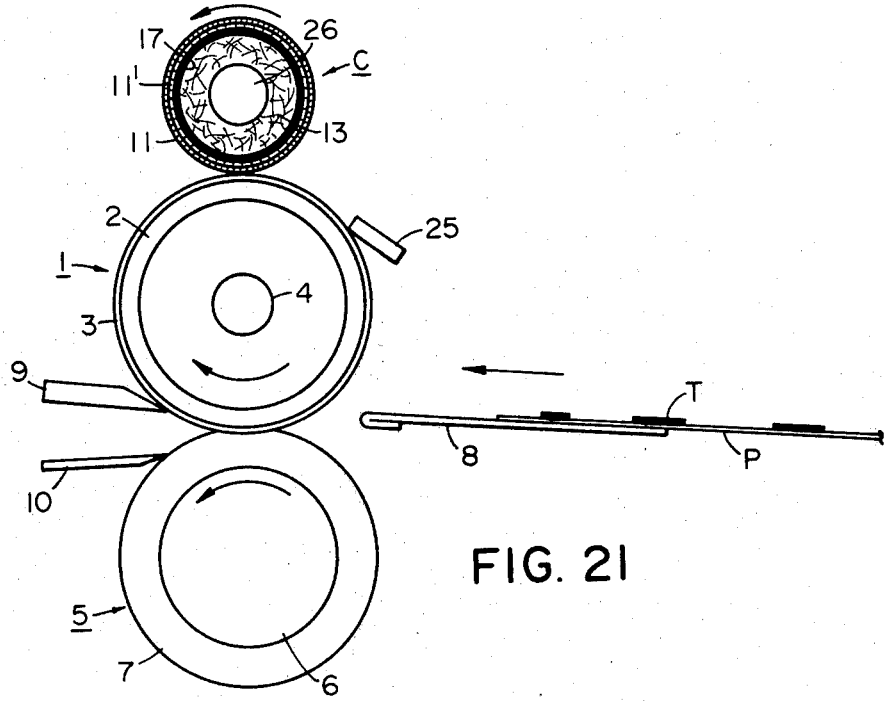
FIGS. 21 and 22 illustrate a further embodiment of the present invention.
Figure 22:
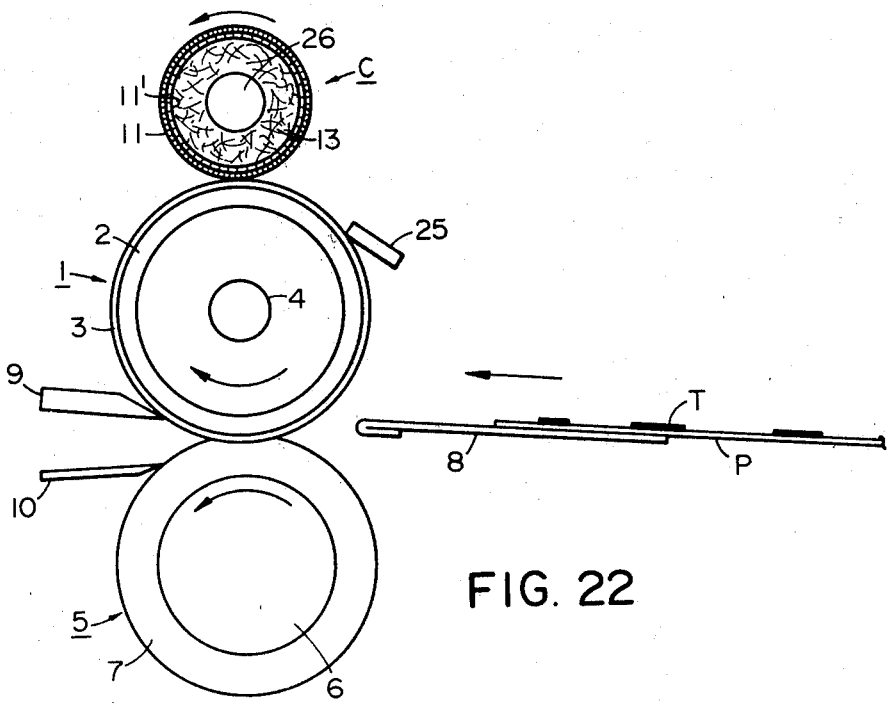

Further, in the foregoing embodiments, a synthetic resin member having fine continuous pores is brought into frictional contact with the roller to thereby apply the offset preventing liquid to the roller. However, the embodiments of FIGS. 21 and 22 are also useful. In these embodiments, the applicator C is formed into a roller shape. Designated by 13 is a layer of felt wrapped around a core roll 26 and having a sufficient hardness to maintain a roller shape, and the layer of felt is impregnated with silicone oil. The surface of this oil retaining layer is coated with a film layer comprising joined synthetic resin films 11' and 11 of Fluoropore or like material having fine continuous pores. This roller-like applicator is brought into contact with the fixing roller 1 and is rotated in the direction of the arrow by the friction force between it and the roller 1 or rotatively driven by a motor. The silicone oil impregnating the felt 13 oozes out through the communicating fine continuous pores of the films 11' and 11 and is applied to the roller 1 with the rotation of the film layer. An advantage of this device is that the contact between the film 11 and the roller 1 is approximate to a line contact and the area of contact therebetween is small and, therefore, coupled with the effect of lamination of the films 11 and 11', the amount of oil applied to the roller 1 can be economized. Also, even if there is a very long down-time of the fixing device, little or no oil collects in the portion of contact between the film 11 and the roller 1.

FIG. 21 is a view corresponding to the X—X cross-section of FIG. 1, and FIG. 22 is a view corresponding to the Y—Y cross-section of FIG. 1. At the end portions of the roller-like applicator C, the obstructing members 17, 17', 17'' and 17''' are provided on the inner surface of the inner film 11', or between the films 11' and 11, or on the surface of the film 11. Alternatively, the end portions of the roller-like applicator C may be filled with a member 131 which is inferior to the felt 13 in the capability of retaining liquid per unit volume. Also, the roller-like applicator C of FIG. 21 or 22 may be brought into contact with the applicator roller 18 of FIG. 11.

In the above-described device, the diameter of the continuous pores of the synthetic resin material used to control the amount of liquid, the pore rate, the thickness of the synthetic resin material, and the viscosity of the offset preventing liquid should be determined by taking into account such factors as the viscosity of toner when melted, the self-support strength of the toner image supporting member, the surface tension of the fixing roller, the peripheral velocity of the fixing roller, etc. However, in the toner image fixing device commonly used in the field of electrophotography or other electrostatic printing, where the applicators as shown in FIGS. 1 to 18 are used, the average diameter of the continuous pores of the film-like member 11 may usually be 0.1 to 5$\mu$, the pore rate may be 20 to 95% and the thickness of the film may be 0.05 to 1 mm, and the viscosity of the offset preventing liquid may be selected in a very wide range of 100 to 100000 cs at room temperature. In order to increase the amount of liquid applied, the viscosity of the offset preventing liquid may be selected at a low level, and the average diameter of the continuous pores of the film-like member may be selected at a large level, and/or the pore rate thereof may be selected to a great greater level, and/or the thickness of the film may be selected to a lower level. In order to decrease the amount of liquid applied, selections inverse to the above may be adopted.

Also, where the devices as shown in FIGS. 19 to 22 are used, generally the pore rate of the communicating continuous pores of the layer comprising films may be 10 to 90%, the thickness of the layer may be 0.1 to 5 mm, the average diameter of the continuous pores of the film brought into contact with the roller may be 0.1 to 5$\mu$, and the average diameter of the continuous pores of the other film may be about approximately of 0.1 to 100$\mu$. The viscosity of the offset preventing liquid may be selected in a wide range of 30 to 100000 cs.

In the above-described embodiments, the offset preventing liquid is directly supplied to the fixing roller by the applicator C having the film 11, but a design may also be made such that the offset preventing liquid is first applied to a pressing roller by the applicator C, and then the liquid is supplied from the pressing roller to the fixing roller.

Further, in the foregoing embodiments, a device in which toner is heated and melted for fixation has been shown, but the present invention is also usable in a pressure fixing device wherein a toner image supporting member is conveyed by being strongly held between a pair of rollers, which is conveyed by being strongly held therebetween by a pressure and the toner image is fixed on the supporting member by such a pressure.

Further, in the illustrated embodiments, reference numeral 25 designates a blade formed of fluorine rubber or the like and bearing against the roller 1. The blade 25 removes from the peripheral surface of the roller 1 any toner or paper powder that has passed through the film 11 or the roller 18 and prevents these materials from adhering to paper P at the nip portion. In fact, most of the toner or paper powder having adhered to the roller 1 is intercepted by the contact starting portion between the film 11 and the roller with respect to the rotational direction of the roller and collects in the front face of the film 11. The toner or paper powder thus collecting in the front face of the film 11 can be simply wiped off by means of cloth or the like. That is, the film 11 acts as a cleaner in addition to its function of applying the offset preventing liquid to the roller surface and squeezing the liquid.

The offset preventing liquid is not limited to silicone oil, therefore liquid polypropylene, liquid polyethylene or the like may also be utilized.

What we claim is:

1. A device for fixing a toner image on an image supporting member, comprising:

a first and a second roller for conveying the image supporting member therebetween and fixing the toner image on the image supporting member; and applicator means, in contact with said first roller, for applying offset preventing liquid to said first roller, wherein the contact portion of said applicator means with said first roller includes a first portion in contact with the fixing action area of said first roller and a second portion including the end areas of said first portion, with respect to the lengthwise direction of said first roller;

said applicator means including a first member for retaining offset preventing liquid, a second member, between said first member and said first roller at least in said portion of contact, formed of synthetic resin having fine continuous pores which are effective to allow the offset preventing liquid to ooze out to the surface of said synthetic resin and be applied to said first roller, and a third member, between said first member and said first roller at said second portion, for obstructing the application of offset preventing liquid to said first roller at said second portion.

2. The device according to claim 1, wherein said third member includes a sealant applied to said synthetic resin having fine continuous pores at said second portion.

3. The device according to claim 1, wherein said third member includes a non-porous member joined to said synthetic resin having fine continous pores at said second portion.

4. The device according to claim 1, wherein said third member includes a member having fine pores and joined to said synthetic resin having fine continuous pores at said second portion.

5. The device according to claim 1, wherein said third member includes a synthetic resin member joined to said synthetic resin having fine continuous pores at said second portion, by being heated at a temperature lower than the melting point of said synthetic resin.

6. The device according to claim 1, wherein the fine continuous pores of said synthetic resin are at least partly destroyed at said second portion and said synthetic resin at said second portion serves also as said third member.

7. The device according to claim 1, wherein said third member includes a member having less retentivity than said first member.

8. the device according to any one of claims 1 to 7, wherein said second member is of a fluoro resin having fine continuous pores.

9. The device according to claim 8, wherein said fluoro resin is tetrafluoroethylene resin.

10. A device for fixing a toner image on an image supporting member, comprising:

a first and a second roller for conveying the image supporting member therebetween and fixing the toner image on the image supporting member;

a movable member for supplying offset preventing liquid to said first roller; and applicator means in contact with said movable member, for applying said offset preventing liquid to said movable member, wherein the contact portion of said applicator means with said movable member includes a first portion contacting the fixing action corresponding area of said movable member and a second portion including the end areas of said first portion with respect to a direction transverse to the direction of movement of said movable member;

said applicator means including a first member for retaining offset preventing liquid, a second member, between said first member and said movable member at least in said portion of contact, formed of synthetic resin having fine continuous pores, which are effective to allow the offset preventing liquid to ooze out to the surface of said synthetic resin and be applied to said movable member and a third member, between said first member and said movable member at said second portion, for obstructing the application of offset preventing liquid to said first roller at said second portion.

11. The device according to claim 10, wherein said third member includes a sealant applied to said synthetic resin having fine continuous pores at said second portion.

12. The device according to claim 10, wherein said third member includes a non-porous member joined to said synthetic resin having fine continuous pores at said second portion.

13. The device according to claim 10, wherein said third member includes a member having fine pores and joined to said synthetic resin having fine continuous pores at said second portion.

14. The device according to claim 10, wherein said third member includes a synthetic resin member joined to said synthetic resin having fine continuous pores at said second portion, by being heated at a temperature lower than the melting point of synthetic resin.

15. The device according to claim 10, wherein the fine continuous pores of said synthetic resin are at least partly destroyed at said second portion and said synthetic resin at said second portion serves also as said third member.

16. The device according to claim 10, wherein said third member includes a member having less retentitivity than said first member.

17. The device according to any one of claims 10 to 16, wherein said second member is a fluoro resin having fine continuous pores.

18. The device according to claim 17, wherein said fluoro resin is tetrafluoroethylene resin.

19. The device according to any one of claims 10 to 16, wherein said movable member includes a roller.

20. A device for fixing a toner image on a image supporting member, comprising:

a first and a second roller for conveying the image supporting member therebetween and fixing the toner image on the image supporting member; and applicator means in contact with said first roller, for applying offset preventing liquid to said first roller;

said applicator means including a first member for retaining offset preventing liquid, a second member, between said first member and said first roller, of synthetic resin having fine continuous pores which are effective to allow the offset preventing liquid to ooze out to the surface of said synthetic resin and be applied to said first roller, said second member having a first portion in contact with the fixing action area of said roller and a second portion including the end portions of the contact portion of said second member with said first roller, with respect to the lengthwise direction of said first roller and surrounding the entire periphery of said first portion, and a third member, between said first member and said first roller at said second portions, for obstructing the application of offset preventing liquid to said first roller at said second portion.

21. The device according to claim 20, wherein said third member includes a sealant applied to said synthetic resin having fine continuous pores at said second portion.

22. The device according to claim 20, wherein said third member includes a non-porous member joined to said synthetic resin having fine continuous pores at said second portion.

23. The device according to claim 20, wherein said third member includes a member having fine pores and joined to said synthetic resin having fine continuous pores at said second portion.

24. The device according to claim 20, wherein said third member includes a synthetic resin member joined to said synthetic resin having fine continuous pores at said second portion, by being heated at a temperature lower than the melting point of said synthetic resin.

25. The device according to claim 20, wherein the fine continuous pores of said synthetic resin are destroyed at said second portion and said synthetic resin at said second portion serves also as said third member.

26. The device according to claim 20, wherein said third member includes a member having less retentivity than said first member.

27. The device according to any one of claims 20 to 26, wherein the width of the end portion of said first portion with respect to the lengthwise direction of said roller is smaller than the width of the central portion thereof.

28. The device according to any one of claims 20 to 26, wherein said synthetic resin having fine continuous pores is a fluoro resin having fine continuous pores.

29. The device according to claim 28, wherein said fluoro resin is tetrafluoroethylene resin.

30. A device for fixing a toner image on an image supporting member, comprising:

a first and a second roller for conveying the image supporting member therebetween and fixing the toner image on the image supporting member;

a movable member for supplying offset preventing liquid to said first roller; and applicator means, in contact with said movable member, for applying the offset preventing liquid to said movable member;

said applicator means including a first member for retaining offset preventing liquid, a second member, between said first member and said movable member, of synthetic resin having fine continuous pores which are effective to allow the offset preventing liquid to ooze out to the surface of said synthetic resin and be applied to said movable member, said second member having a first portion in contact with the fixing action corresponding area of said movable member and a second portion including the end portions of the contact portion of said second member with said movable member, with respect to a direction transverse to the direction of movement of said movable member and surrounding the entire periphery of said first portion, and a third member between said first member and said movable member at said second portion for obstructing the application of offset preventing liquid to said first roller at the second portion.

31. The device according to claim 30, wherein said third member includes a sealant applied to said synthetic resin having fine continuous pores at said second portion.

32. The device according to claim 30, wherein said third member includes a non-porous member joined to said synthetic resin having fine continuous pores at said second portion.

33. The device according to claim 30, wherein said third member includes a member having fine pores and joined to said synthetic resin having fine continuous pores at said second portion.

34. The device according to claim 30, wherein said third member includes a synthetic resin member joined to said synthetic resin having fine continuous pores at said second portion, by being heated at a temperature lower than the melting point of said synthetic resin.

35. The device according to claim 30, wherein the fine continuous pores of said synthetic resin are at least partly destroyed at said second portion and said synthetic resin at said second portion serves also as said third member.

36. The device according to claim 30, wherein said third member includes a member having less retentivity than said first member.

37. The device according to any one of claims 30 to 36, wherein the width of the end portion of said first portion with respect to the lengthwise direction of said roller is smaller than the width of the central portion thereof.

38. The device according to any one of claims 30 to 36, wherein said movable member is a roller.

39. The device according to any one of claims 30 to 36, wherein said synthetic resin having fine continuous pores is a fluoro resin having fine continuous pores.

40. The device according to claim 39, wherein said fluoro resin is tetrafluoroethylene resin.

41. The device according to any one of claims 1 to 7, 10 to 16, 20 to 26 and 30 to 36, wherein said synthetic resin having fine continuous pores is in the form of a film at at least said first portion.

42. The device according to claim 41, wherein said film-like synthetic resin is formed by stretching in the same direction as the direction of rotation of said first roller.

43. The device according to claim 41, wherein at at least said first portion, one or more synthetic resin films having fine continuous pores are layered on said film-like synthetic resin.

44. The device according to claim 43, wherein said film-like resin is formed by stretching, and at least two layers of the plural layers of the film-like resin have stretching directions which are non-parallel.

45. A device for fixing a toner image on an image supporting member, comprising:

a first and a second roller for conveying the image supporting member therebetween and fixing the toner image on the image supporting member;

applicator means, in contact with said first roller, for applying offset preventing liquid to said first roller, wherein the contact portion of said applicator means with said first roller includes a first portion contacting the fixing action area of said first roller and a second portion including the end areas of said contact portion, with respect to the lengthwise direction of said first roller;

said applicator means including a retaining portion for retaining offset preventing liquid, a limiting member, between said first member and said first roller at least in said contact portion, formed of synthetic resin having fine continuous pores which are effective to allow the offset preventing liquid to ooze out to the surface of said synthetic resin and be applied to said first roller, and an obstructing portion, between said retaining portion and said first roller at said second portion, for obstructing the application of the offset preventing liquid to said first roller at the second portion.

46. A device for fixing a toner image on an image supporting member, comprising:

a first and a second roller for conveying the image supporting member therebetween and fixing the toner image on the image supporting member;

a movable member for supplying offset preventing liquid to said first roller; and applicator means, in contact with said movable member, for applying the offset preventing liquid to said movable member, wherein the contact portion of said applicator means with said movable member comprises a first portion contacting the fixing action corresponding area of said movable member and a second portion including the end areas of said contact portion, with respect to a direction transverse to the direction of movement of said movable member;

said applicator means including a retaining portion for retaining offset preventing liquid, a limiting member, between said retaining portion and said movable member at least in said contact portion, formed of synthetic resin having fine continuous pores which are effective to allow the offset preventing liquid to ooze out to the surface of said synthetic resin and be applied to said movable member, and an obstructing portion, between said first member and said movable member at said second portion, for obstructing the application of the offset preventing liquid to said first roller at the second portion.

47. The device according to claim 45 or 46, wherein said obstructing portion has, at said second portion, a part provided with one or more layers of limit assisting members which are of a resin having fine continuous pores.

48. The device according to claim 47, wherein at least two of said limiting and limit assisting members have pores which are different in relative size.

49. The device according to claim 48, wherein one of said limiting and limit assisting members has pores which are smaller than those of another said member which is nearer to said retaining portion than said one member.

50. A device for fixing a toner image on an image supporting member, comprising:

a first and a second roller for conveying the image supporting member therebetween and fixing the toner image on the image supporting member;

applicator means, in contact with said first roller, for applying offset preventing liquid to said first roller;

said applicator means including a retaining portion for retaining offset preventing liquid, and a limiting member, between said retaining portion and said first roller, of synthetic resin having fine continuous pores which are effective to allow the offset preventing liquid to ooze out to the surface of said synthetic resin and be applied to said first roller, said limiting member having a first portion in contact with the fixing action area of said first roller and a second portion including the end portions of the contact portion of said limiting member with said first roller, with respect to the lengthwise direction of said first roller, and surrounding the entire periphery of said first portion, and an obstructing portion, between said retaining portion and said first roller at said second portion, for obstructing the application of offset preventing liquid to said first roller at the second portion.

51. A device for fixing a toner image on an image supporting member, comprising:

a first and a second roller for conveying the image supporting member therebetween and fixing the toner image on the image supporting member;

a movable member for supplying offset preventing liquid to said first roller; and applicator means, in contact with said movable member, for applying the offset preventing liquid to said movable member;

said applicator means including a retaining portion for retaining offset preventing liquid, a limiting member, between said retaining portion and said movable member, of synthetic resin having fine continuous pores which are effective to allow the offset preventing liquid to ooze out to the surface of said synthetic resin and be applied to said movable member, said limiting member having a first portion in contact with the fixing action corresponding area of said movable member and a second portion including the end portions of the contact portion of said limiting member with said movable member, with respect to a direction transverse to the direction of movement of said movable member and surrounding the entire periphery of said first portion, and an obstructing portion between said retaining portion and said movable member at said second portion for obstructing the application of the offset preventing liquid to said first roller at the second portion.

52. The device according to claim 50 or 51, wherein said obstructing portion has, at least at said second portion, a part provided with one or more layers of a limit assisting member of a resin having fine continuous pores.

53. The device according to claim 52, wherein at least two of said limiting and limit assisting members have pores which are different in relative size.

54. The device according to claim 53, wherein one of said limiting and limit assisting members has pores which are smaller than those of another said member which is nearer to said retaining portion than said one member.

55. The device according to claim 52, wherein said second portion has a smaller width at its end portions than in the middle thereof.

56. The device according to claim 53, wherein said second portion has a smaller width at its end portions than in the middle thereof.

57. The device according to claim 54, wherein said second portion has a smaller width at its end portions than in the middle thereof.

58. A device for fixing a toner image in an image supporting member, comprising:

a first and a second roller for conveying the image supporting member therebetween and fixing the toner image on the image supporting member; and applicator means, in contact with said first roller, for applying offset preventing liquid to said first roller, wherein in the contact portion of said applicator means with said first roller includes a first portion contacting the fixing action area of said first roller and a second portion including the end areas of said contact portion, with respect to the lengthwise direction of said first roller;

said applicator means including a retaining portion for retaining offset preventing liquid, a limiting member, between said retaining portion and said first roller at least in said contact portion, formed of synthetic resin having fine continuous pores, which are effective to allow the offset preventing liquid to ooze out to the surface of said synthetic resin and be applied to said first roller, and an obstructing member, on the second portion of said limiting member, for obstructing the application of the offset preventing liquid to said first roller at the second portion.

59. A device for fixing a toner image on an image supporting member, comprising:

a first and a second roller for conveying the image supporting member therebetween and fixing the toner image on the image supporting member;

a movable member for supplying offset preventing liquid to said first roller; and applicator means, in contact with said movable member, for applying the offset preventing liquid to said movable member, wherein the contact portion of said applicator means with said movable member includes a first portion contacting the fixing action corresponding area of said movable member and a second portion including the end areas of said contact portion, with respect to a direction across to the direction of movement of said movable member;

said applicator means including a retaining portion for retaining offset preventing liquid, a limiting member, between said retaining portion and said movable member at least in said contact portion, formed of synthetic resin having fine continuous pores which are effective to allow the offset preventing liquid to ooze out to the surface of said synthetic resin and be applied to said movable member, and an obstructing member, on the second portion of said limiting member, for obstructing the application of the offset preventing liquid to said first roller at the second portion.

60. A device for fixing a toner image on an image supporting member, comprising:

a first and a second roller for conveying the image supporting member therebetween and fixing the toner image on the image supporting member; and applicator means, in contact with said first roller, for applying offset preventing liquid to said first roller;

said applicator means including a retaining member for retaining offset preventing liquid, and a limiting member, between said retaining member and said first roller, of synthetic resin having fine continuous pores which are effective to allow the offset preventing liquid to ooze out to the surface of said synthetic resin and be applied to said first roller, said limiting member having a first portion in contact with the fixing action area of said first roller and a second portion including the end portions of the contact portion of said limiting member with said first roller, with respect to the lengthwise direction of said first roller and surrounding the entire periphery of said first portion, and an obstructing member on the second portion of said limiting member, for obstructing the application of the offset preventing liquid to said first roller at the second portion.

61. A device for fixing a toner image on an image supporting member, comprising:

a first and second roller for conveying the image supporting member therebetween and fixing the toner image on the image supporting member;

a movable member for supplying offset preventing liquid to said first roller; and applicator means, in contact with said movable member, for applying the offset preventing liquid to said movable member;

said applicator means including a retaining portion for retaining offset preventing liquid, a limiting member, between said retaining portion and said movable member, of synthetic resin having fine continuous pores which are effective to allow the offset preventing liquid to ooze out to the surface of said synthetic resin and be applied to said movable member, said limiting member including a first portion in contact with the fixing action corresponding area of said movable member and a second portion including the end portions of the contact portion of said limiting member with said movable member, with respect to a direction transverse to the direction of movement of said movable member and surrounding the entire periphery of said first portion, and an obstructing member on said second portion of said limiting member, for obstructing the application of offset preventing liquid to said first roller at the second portion.

62. The device according to claim 60 or 61, wherein said second portions have a smaller width at their end portion than in the middle thereof.

63. The device according to claim 1, 10, 20, 30, 45, 46, 50, 51, 58, 59, 60 or 61, wherein said applicator means is detachably mounted on said fixing device.

64. The device according to claim 1, 10, 20 or 30, wherein said second member is a roller member.

65. The device according to claim 45, 46, 50, 51, 58, 59, 60 or 61, wherein said limiting member is a roller member.

* * * * *